US008186669B2

(12) United States Patent
Ohkura

(10) Patent No.: US 8,186,669 B2
(45) Date of Patent: May 29, 2012

(54) SHEET FEEDER DEVICE AND IMAGE FORMING APPARATUS

(75) Inventor: Yoshimasa Ohkura, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 13/190,959

(22) Filed: Jul. 26, 2011

(65) Prior Publication Data

US 2012/0025451 A1 Feb. 2, 2012

(30) Foreign Application Priority Data

Jul. 30, 2010 (JP) ..... 2010-171247

(51) Int. Cl.
*B65H 3/06* (2006.01)
*B65H 1/00* (2006.01)

(52) U.S. Cl. ..... 271/117; 271/171

(58) Field of Classification Search ..... 271/117, 271/118, 171
See application file for complete search history.

(56) References Cited

U.S. PATENT DOCUMENTS 5,294,104 A * 3/1994 Nishigaki ..... 271/117
8,011,653 B2 * 9/2011 Mayne ..... 271/117
2011/0298174 A1 * 12/2011 Wang ..... 271/226

FOREIGN PATENT DOCUMENTS

JP 06234437 A * 8/1994
JP 2001-242563 9/2001
JP 2007-22762 2/2007
JP 2009-38787 2/2009
JP 2010-70362 4/2010

* cited by examiner

*Primary Examiner* — David H Bollinger
(74) *Attorney, Agent, or Firm* — Dilworth & Barrese, LLP

(57) ABSTRACT

A paper feed cassette of an image forming apparatus is provided with a sheet receptacle and a pair of width adjustment guides. A cassette feeder of the image forming apparatus is provided with a plurality of rollers, a plurality of roller holders, and a plurality of roller biasing members. When the paper feed cassette is mounted on a feeder housing, an upper end of width adjustment guides is configured to cause at least one of the roller holders to move upward in a height direction of the image forming apparatus such that at least one of the rollers does not come in contact with a topmost sheet of paper.

8 Claims, 7 Drawing Sheets

SHEET FEEDER DEVICE AND IMAGE FORMING APPARATUS

This application is based on and claims the benefit of priority from Japanese Patent Application No. 2010-171247, filed on 30 Jul. 2010, the content of which is incorporated herein by reference.

BACKGROUND OF THE INVENTION

1. Field of the Invention

The present invention relates to a sheet feeder device and an image forming apparatus.

2. Related Art

An image forming apparatus, such as a copier, printer and facsimile machine, is generally provided with: an image carrier (photoreceptor drum); a developer which converts an electrostatic latent image formed on the image carrier into a toner image; a toner container (also called "toner cartridge" or the like) which stores the toner; a transfer unit which transfers the toner image formed on the image carrier onto a sheet of paper or the like; a fixing unit which fixes the toner image transferred to the paper; and a sheet feeder device having a sheet feeder which conveys a sheet of paper to the transfer unit, the fixing unit, and the like, and a sheet feed cassette which stores a plurality of stacked sheets of paper, which is to be sent to the transfer unit, and a cassette housing which houses the sheet feed cassette.

When the sheet feed cassette of the sheet feeder device, which stores stacked sheets of paper, is housed in the cassette housing, the sheet feeder device causes a pickup roller to rotate to feed a topmost sheet of paper in a feed direction to the fixing unit, while the pickup roller provided in the cassette housing presses from above the topmost sheet of paper located at the top of the plurality of stacked sheets of paper.

In order to store a plurality of sets of stacked sheets of paper having various sizes set by set, the paper feed cassette is provided with an end adjustment guide configured to align ends of the plurality of stacked sheets of paper in the feed direction and a pair of width adjustment guides configured to align the plurality of stacked sheets of paper in a width direction. Size of a sheet of paper included in the plurality of stacked sheets of paper includes one of B5 size, B4 size, and A3 size (based on Japan Industrial Standard (JIS)), for example. In addition, there may be different directions with respect to the arrangement of the plurality of stacked sheets of paper: the longer direction or shorter direction coincides with the feed direction.

For example, a sheet feeder device is proposed which usually feeds a topmost sheet of paper in the feed direction with one pickup roller regardless of the size of the stacked sheets of paper stored in the paper feed cassette. In this example, the pickup roller is configured to apply a larger pressing force to press the topmost sheet of paper so that a sheet of paper of the largest size storable in the paper feed cassette is fed reliably.

SUMMARY OF THE INVENTION

However, in the sheet feeder device described above as an example, the pickup roller presses a sheet of paper having a smaller size stored in the paper feed cassette with the same larger pressing force similarly to the sheet of paper having a large size. Accordingly, the topmost sheet of paper is pressed with an excessive force. Therefore, the pickup roller tends to cause multiple feeding where a plurality of sheets of paper is fed together.

The present invention provides an image forming apparatus and a sheet feeder device provided with a low cost sheet feeder for minimizing multiple feeding of a plurality of types of sheets of medium.

A sheet feeder device according to the present invention includes a sheet feeder configured to store a plurality of sheets of media and a case having a feeder housing configured to attachably and detachably mount the sheet feeder. The sheet feeder includes a sheet receptacle configured to store the plurality of sheets of media such that the plurality of sheets of media is conveyable in a conveyance direction and a pair of width adjustment guides configured to position each of the plurality of sheets of media in a sheet width direction. The pair of width adjustment guides is attached to the sheet receptacle such that a position of the pair of width adjustment guides is adjustable in the sheet width direction. The feeder housing includes a plurality of rollers, a plurality of roller holders, a plurality of roller biasing members and a roller driver unit. The plurality of rollers is arranged on an exit side of the sheet feeder that is mounted on the feeder housing. The plurality of rollers is spaced each other in the width direction. The plurality of roller holders is configured to hold the plurality of rollers rotatable and movable in a sheet thickness direction. The plurality of roller biasing members is configured to bias the plurality of roller holders to come in contact with a topmost sheet of medium, when the sheet feeder is mounted on the feeder housing. The roller driver unit is configured to cause the plurality of rollers to rotate. The pair of width adjustment guides includes a pair of facing parts configured to face both side surfaces of the plurality of sheets of media, a pair of guide positioning units configured to position the pair of facing parts and a guide end configured to cause one of the plurality of roller holders to move more upward than other remaining roller holders, when the sheet feeder is mounted on the feeder housing.

An image forming apparatus according to the present invention includes: an image forming device that is provided in the case and configured to form an image on a sheet of medium; and the sheet feeder device described above configured to supply the sheet of medium to the image forming device.

According to the present invention, it is possible to provide an image forming apparatus and a sheet feeder device provided with a low cost sheet feeder for minimizing multiple feeding for a case where a variety of sheets of paper are used.

DETAILED DESCRIPTION OF THE INVENTION

Hereafter, embodiments of the sheet feeder device and the image forming apparatus of the present invention will be described with reference to the drawings.

Figure 1:
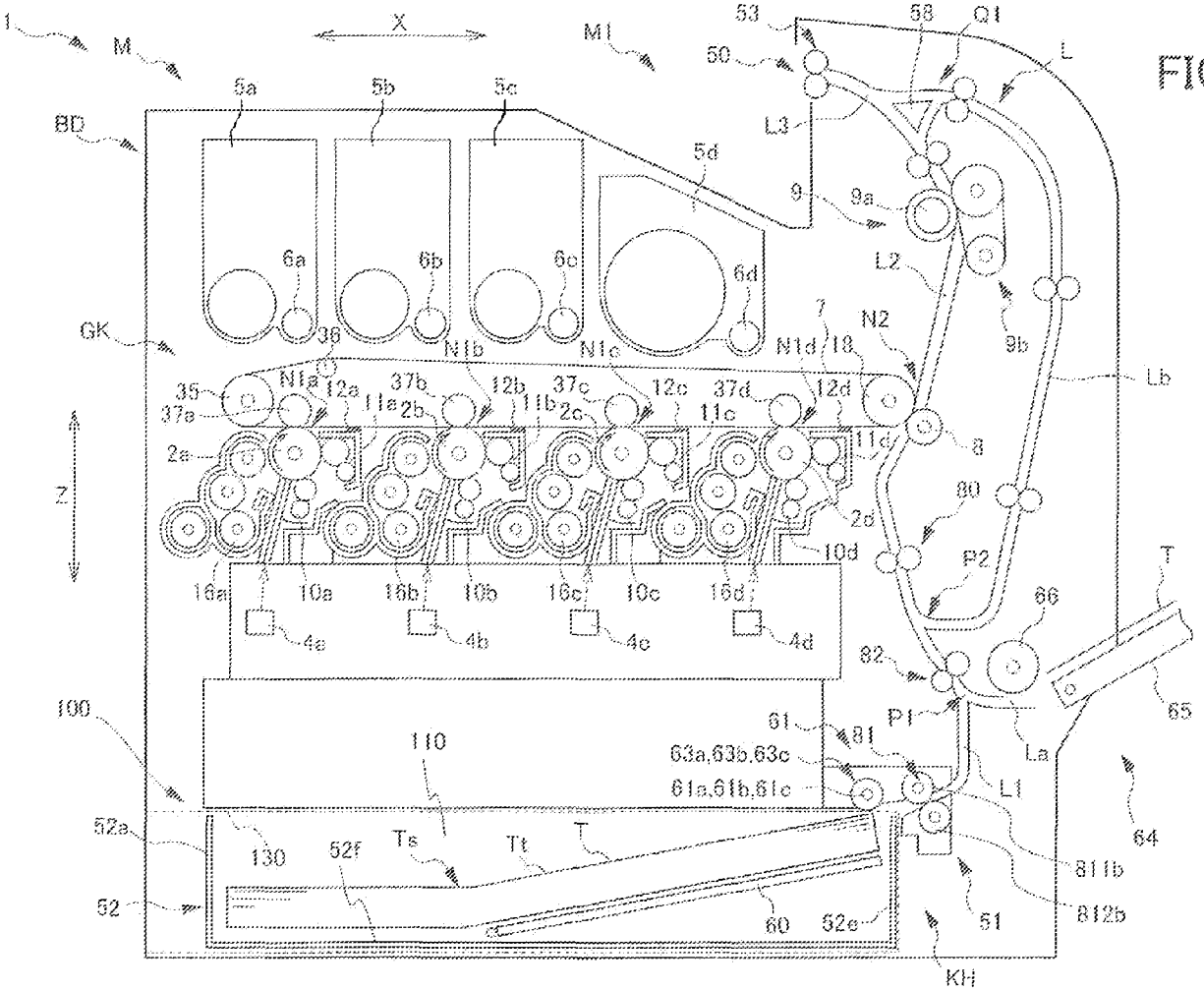
FIG. 1 is a front view for explaining an arrangement of components in a printer 1 of a first embodiment of the present invention.

The entire structure of a printer 1, which is an image forming apparatus of a first embodiment, will be described with reference to FIG. 1. FIG. 1 is a front view for explaining an arrangement of components in the printer 1, which is the first embodiment of the present invention.

In the description below, left and right directions are denoted as a direction of arrow X, front and back (depth) directions as a direction of arrow Y (refer to FIG. 2), and up and down directions a direction of arrow Z, when viewed by a user standing at the front of the printer 1. In addition, a direction in which a topmost sheet of paper Tt is conveyed in the direction of arrow X to an image forming unit GK is denoted as a conveyance direction F1 (refer to FIG. 2).

Printer 1

As shown in FIG. 1, the printer 1, which is an image forming apparatus, includes: a main cabinet M; an image forming unit GK which forms a toner image on a sheet of paper T (material to be transferred an image), based on predetermined image information; and a paper feed and discharge portion KH which discharges the sheet of paper T on which a toner image is formed in collaboration with a sheet feeder device 100 which feeds the sheet of paper T to the image forming unit GK.

The exterior contour of the main cabinet M is configured by a case BD, which is a housing.

As shown in FIG. 1, the image forming unit GK includes: photoreceptor drums 2*a*, 2*b*, 2*c*, and 2*d* as image carriers; charging units 10*a*, 10*b*, 10*c* and 10*d*; laser scanner units 4*a*, 4*b*, 4*c* and 4*d* as exposure units; developing units 16*a*, 16*b*, 16*c* and 16*d*; toner cartridges 5*a*, 5*b*, 5*c* and 5*d*; toner supply units 6*a*, 6*b*, 6*c* and 6*d*; drum cleaning units 11*a*, 11*b*, 11*c* and 11*d*; neutralization units 12*a*, 12*b*, 12*c* and 12*d*; an intermediate transfer belt 7; primary transfer rollers 37*a*, 37*b*, 37*c* and 37*d*; a secondary transfer roller 8; an opposing roller 18; and a fixing unit 9.

The paper feed and discharge portion NH includes: a paper feed cassette 52; a manual paper feed unit 64; a conveyance path L of a sheet of paper T; a pair of registration rollers 80; a plurality of rollers or pair of rollers and a paper discharging unit 50. It should be noted that the conveyance path L includes a first conveyance path L1, second conveyance path L2, third conveyance path L3, manual feed conveyance path La, and a return conveyance path Lb, as will be described later.

Hereafter, configurations of the image forming unit GK and the paper feed and discharge portion KH will be described in detail.

Image Forming Unit GK

First, the image forming unit GK will be described.

In the image forming unit GK, when the photoreceptor drums 2*a*, 2*b*, 2*c* and 2*d* rotate at a time of forming an image, the following are performed in this order to a surface of each of the photoreceptor drums 2*a*, 2*b*, 2*c* and 2*d*. That is, charging performed by the charging units 10*a*, 10*b*, 10*c* and 10*d*, exposure performed by the laser scanner unit 4*a*, 4*b*, 4*c* and 4*d*, development performed by the developing units 16*a*, 16*b*, 16*c* and 16*d*, primary transfer performed by the intermediate transfer belt 7 and the primary transfer rollers 37*a*, 37*b*, 37*c* and 37*d*, neutralization performed by the neutralization units 12*a*, 12*b*, 12*c* and 12*d*, and cleaning performed by the drum cleaning units 11*a*, 11*b*, 11*c* and 11*d*.

In addition, in the image forming unit GK, secondary transfer is performed by the intermediate transfer belt 7, the secondary transfer roller 8 and the opposing roller 18, and fixing is performed by the fixing unit 9.

Each of the photoreceptor drums 2*a*, 2*b*, 2*c* and 2*d* has a cylindrical shape and functions as a photoreceptor or an image carrier. Each of the photoreceptor drums 2*a*, 2*b*, 2*c* and 2*d* is arranged rotatable in a direction of arrows shown in FIG. 1, about a rotational axis extending in a direction (direction of arrow Y) that is perpendicular to the direction of the movement of the intermediate transfer belt 7. An electrostatic latent image is formed on a surface of each of the photoreceptor drums 2*a*, 2*b*, 2*c* and 2*d*.

Each of the charging units 10*a*, 10*b*, 10*c* and 10*d* is arranged opposite to the surface of each of the photoreceptor drums 2*a*, 2*b*, 2*c* and 2*d*. Each of the charging units 10*a*, 10*b*, 10*c* and 10*d* positively electrifies the surface of each of the photoreceptor drums 2*a*, 2*b*, 2*c* and 2*d* in a uniform manner (positive polarity).

The laser scanner units 4*a*, 4*b*, 4*c* and 4*d* function as exposure units. Each of the laser scanner units 4*a*, 4*b*, 4*c* and 4*d* is arranged apart from the surface of each of the photoreceptor drums 2*a*, 2*b*, 2*c* and 2*d*. Each of the laser scanner units 4*a*, 4*b*, 4*c* and 4*d* is constituted by a laser light source, polygon mirror, polygon mirror driving motor(not illustrated), and the like.

Each of the laser scanner units 4*a*, 4*b*, 4*c* and 4*d* performs scanning exposure of the surface of each of the photoreceptor drums 2*a*, 2*b*, 2*c* and 2*d*, based on image information supplied from an external device such as a personal computer (PC). An electric charge at an exposed part of the surface of each of the photoreceptor drums 2*a*, 2*b*, 2*c* and 2*d* is removed by the scanning exposure performed by each of the laser scanner units 4*a*, 4*b*, 4*c* and 4*d*. In this manner, an electrostatic latent image is formed on the surface of each of the photoreceptor drums 2*a*, 2*b*, 2*c* and 2*d*.

The developing units 16*a*, 16*b*, 16*c* and 16*d* are provided corresponding to the photoreceptor drums 2*a*, 2*b*, 2*c* and 2*d*, respectively. Each of the developing units 16*a*, 16*b*, 16*c* and 16*d* is arranged opposite to the surface of each of the photoreceptor drums 2*a*, 2*b*, 2*c* and 2*d*. Each of the developing units 16*a*, 16*b*, 16*c* and 16*d* causes a toner of a color to adhere to a part where the electric charge of the electrostatic latent image formed on the surface of each of the photoreceptor drums 2*a*, 2*b*, 2*c* and 2*d* is removed, thereby forming a color toner image on the surface of each of the photoreceptor drums 2*a*, 2*b*, 2*c* and 2*d*. The developing units 16*a*, 16*b*, 16*c* and 16*d* correspond to four colors, yellow, cyan, magenta, and black, respectively. Each of the developing units 16*a*, 16*b*, 16*c* and 16*d* includes a developing roller arranged opposite to the surface of each of the photoreceptor drums 2*a*, 2*b*, 2*c* and 2*d*, and an agitation roller for agitating the toner.

The toner cartridges 5*a*, 5*b*, 5*c* and 5*d* are provided corresponding to the developing units 16*a*, 16*b*, 16*c* and 16*d*, respectively. Each of the toner cartridges 5*a*, 5*b*, 5*c* and 5*d* stores the toner of a color to be supplied for each of the developing units 16*a*, 16*b*, 16*c* and 16*d*. The toner cartridges 5*a*, 5*b*, 5*c* and 5*d* store yellow toner, cyan toner, magenta toner, and black toner, respectively.

The toner supply units 6*a*, 6*b*, 6*c* and 6*d* are provided corresponding to the toner cartridges 5*a*, 5*b*, 5*c* and 5*d* and the developing units 16*a*, 16*b*, 16*c* and 16*d*, respectively. Each of the toner supply units 6*a*, 6*b*, 6*c* and 6*d* supplies the toner of a color stored in each of the toner cartridges 5*a*, 5*b*, 5*c* and 5*d* to each of the developing units 16*a*, 16*b*, 16*c* and 16*d*. The toner supply units 6*a*, 6*b*, 6*c* and 6*d* and the developing units 16*a*, 16*b*, 16*c* and 16*d* are connected by a toner conveyance device (not illustrated), respectively.

A toner image of each color, which is formed on each of the photoreceptor drums 2*a*, 2*b*, 2*c* and 2*d*, is sequentially subjected to the primary transfer to the intermediate transfer belt 7. The intermediate transfer belt 7 is suspended on a follower roller 35 and the opposing roller 18 functioning as a driving roller, a tension roller 36, and the like. Since the tension roller 36 applies a force to the intermediate transfer belt 7 inside to outside, a predetermined tension is given to the intermediate transfer belt 7.

Each of the primary transfer rollers 37*a*, 37*b*, 37*c* and 37*d*, is arranged opposite to each of the photoreceptor drums 2*a*, 2*b*, 2*c* and 2*d* across the intermediate transfer belt 7.

The intermediate transfer belt 7 is sandwiched between each of the primary transfer rollers 37*a*, 37*b*, 37*c* and 37*d* and each of the photoreceptor drums 2*a*, 2*b*, 2*c* and 2*d*. A sandwiched part is pressed against the surface of each of the photoreceptor drums 2*a*, 2*b*, 2*c* and 2*d*. Primary transfer nips N1*a*, N1*b*, N1*c* and N1*d* are formed between the photoreceptor drums 2*a*, 2*b*, 2*c* and 2*d* and the primary transfer rollers 37*a*, 37*b*, 37*c* and 37*d*, respectively. At the primary transfer nips N1*a*, N1*b*, N1*c* and N1*d*, toner images of respective colors formed on the photoreceptor drums 2*a*, 2*b*, 2*c* and 2*d* are sequentially transferred to the intermediate transfer belt 7. In this manner, a full color toner image is formed on the intermediate transfer belt 7.

A primary transfer bias for causing the toner images of respective colors formed on the photoreceptor drums 2*a*, 2*b*, 2*c* and 2*d* to transfer to the intermediate transfer belt 7 is applied to the primary transfer rollers 37*a*, 37*b*, 37*c* and 37*d* by a primary transfer bias application unit (not illustrated), respectively.

Each of the neutralization units 12*a*, 12*b*, 12*c* and 12*d* is arranged opposite to the surface of each of the photoreceptor drums 2*a*, 2*b*, 2*c* and 2*d*. Each of the neutralization units 12*a*, 12*b*, 12*c* and 12*d* irradiates light on the surface of each of the photoreceptor drums 2*a*, 2*b*, 2*c* and 2*d* so as to remove electricity from the surface of each of the photoreceptor drums 2*a*, 2*b*, 2*c* and 2*d* having undergone the primary transfer.

Each of the drum cleaning units 11*a*, 11*b*, 11*c* and 11*d* is arranged opposite to the surface of each of the photoreceptor drums 2*a*, 2*b*, 2*c* and 2*d*. Each of the drum cleaning units 11*a*, 11*b*, 11*c* and 11*d* removes toner and adherent remaining on the surface of each of the photoreceptor drums 2*a*, 2*b*, 2*c* and 2*d*, after the primary transfer, and conveys the removed toner and the like to a predetermined collecting mechanism for collection.

The secondary transfer roller 8 causes the full color toner image primarily transferred to the intermediate transfer belt 7 to be secondarily transferred to a sheet of paper T. A secondary transfer bias for causing the full color toner image formed on the intermediate transfer belt 7 to be transferred to the sheet of paper T is applied to the secondary transfer roller 8 by a secondary transfer bias application unit (not illustrated).

The secondary transfer roller 8 is configured to come in contact with or be spaced apart from the intermediate transfer belt 7. More specifically, the secondary transfer roller 8 is configured to be movable between a contact position and a separate position: At the contact position the secondary transfer roller 8 is in contact with the intermediate transfer belt 7. At the separate position it is spaced apart from the intermediate transfer belt 7. In this connection, the secondary transfer roller 8 is arranged at the contact position, when the full color toner image primarily transferred to a surface of the intermediate transfer belt 7 is secondarily transferred to the sheet of paper T, and is arranged at the separate position in other cases.

The opposing roller 18 is arranged opposite to the secondary transfer roller 8, interposing the intermediate transfer belt 7 therebetween. The intermediate transfer belt 7 is sandwiched by the secondary transfer roller 8 and the opposing roller 18. The sheet of paper T is pressed against the outside surface (the surface where the toner image is primarily transferred) of the intermediate transfer belt 7. A secondary transfer nip N2 is formed between the intermediate transfer belt 7 and the secondary transfer roller 8. At the secondary transfer nip N2, the full color toner image primarily transferred to the intermediate transfer belt 7 is secondarily transferred to the sheet of paper T.

The fixing unit 9 melts and applies pressure to the toners of respective colors forming the toner image that has been secondarily transferred to the sheet of paper T, and fixes the toner image on the sheet of paper T. The fixing unit 9 is provided with a heating cylinder 9*a* which is heated with a heater, and a pressing cylinder 9*b* which is in pressure contact with the heating cylinder 9*a*. The heating cylinder 9*a* and pressing cylinder 9*b* sandwich and apply pressure to the sheet of paper T to which the toner image has been secondarily transferred, and convey the sheet of paper T. Since the sheet of paper T is conveyed while sandwiched between the heating cylinder 9*a* and the pressing cylinder 9*b*, the toner transferred to the sheet of paper T is melted and applied pressure, so that the toner is fixed on the sheet of paper T.

Paper Feed and Discharge Portion KH

Next, the paper feed and discharge portion KH will be described.

As shown in FIG. 1, the paper feed cassette 52 that stores a plurality of stacked sheets of paper Ts is arranged at a lower part of the main cabinet M. The plurality of stacked sheets of paper Ts is obtained by stacking sheets of paper T in a thickness direction of paper (direction of arrow Z). A sheet of paper T has a rectangular shape. Accordingly, the plurality of stacked sheets of paper Ts has a rectangular parallelepiped shape.

The paper feed cassette 52 is housed in a feeder housing 130, which is formed in the main cabinet M, attachably and detachably in the direction of arrow X.

The paper feed cassette 52 is configured to be horizontally withdrawable from the case BD of the main cabinet M (direction of arrow X). A placing board 60 for placing the plurality of stacked sheets of paper Ts having a rectangular parallelepiped shape is arranged at the paper feed cassette 52.

The plurality of stacked sheets of paper Ts is stored on the placing board 60 in the paper feed cassette 52. A topmost sheet of paper Tt located at the top of the plurality of stacked sheets of paper Ts that is stacked on the placing board 60 is fed as a sheet of paper T to the conveyance path L by the cassette feeder 51, which is arranged at an end of the paper feed cassette 52 on an exit side (right-end side in FIG. 1). The cassette paper feed unit 51 includes a double-feed prevention mechanism that is composed of a forward feed roller 61 for picking up a sheet of paper T from the placing board 60, and a pair of feed rollers 81 for feeding the sheet of paper T to the conveyance path L on a sheet by sheet basis. The pair of paper feed rollers 81 is provided with an upper paper feed roller 811*b* and a lower paper feed roller 812*b*.

The details of the paper feed cassette 52 and the cassette feeder 51 of the sheet feeder device 100 will be described later.

The manual paper feed unit 64 is provided at the right side surface of the main cabinet M (right side in FIG. 1). The main purpose of providing the manual paper feed unit 64 is to supply the main cabinet M a sheet of paper that has a size or type different from the sheet of paper T that is set on the paper feed cassette 52. The manual paper feed unit 64 is provided with a manual tray 65 that forms a part of a right surface of the main cabinet M when the manual paper feed unit 64 is closed, and a paper feed roller 66. The lower end of the manual tray 65 is rotatably (openably and closably) attached proximity to the paper feed roller 66. A sheet of paper T is placed on the manual tray 65 when it is open. The paper feed roller 66 feeds the sheet of paper T placed on the opened manual tray 65 to the manual feed conveyance path La.

The conveyance path L for conveying the sheet of paper T includes: the first conveyance path L1 from the cassette feeder 51 to the secondary transfer nip N2; the second conveyance path L2 from the secondary transfer nip N2 to the fixing unit 9; the third conveyance path L3 from the fixing unit 9 to the paper discharging unit 50; the manual feed conveyance path La that causes a sheet of paper supplied from the manual paper feed unit 64 to join the first conveyance path L1: and the return conveyance path Lb that causes a sheet of paper, which is conveyed on the third conveyance path L3 from downstream to upstream, to be turned over and conveyed back to the first conveyance path L1.

In addition, a first joint portion P1 and a second joint portion P2 are formed midway on the first conveyance path L1. The first branch portion Q1 is formed midway on the third conveyance path L3.

The first joint portion P1 is where the manual feed conveyance path La joins the first conveyance path L1. The second joint portion P2 is where the return conveyance path Lb joins the first conveyance path L1.

The first branch portion Q1 is where the return conveyance path Lb branches from the third conveyance path L3.

A paper detection sensor (not illustrated) for detecting a sheet of paper T and the pair of registration rollers 80 are disposed midway on the first conveyance path L1 (more specifically between the second joint portion P2 and the secondary transfer nips N2). The pair of registration rollers 80 is configured to correct skew (diagonal paper feed) of the sheet of paper T and to adjust the timing of feeding the sheet of paper with respect to the formation of a toner image at the image forming unit GK. The paper detection sensor is arranged immediately before the pair of registration rollers 80 in the conveyance direction of the sheet of paper T (upstream in the conveyance direction). The pair of registration rollers 80 performs the above described correction and timing adjustment based on the detection signal information sent from the paper detection sensor and conveys the sheet of paper T.

A pair of intermediate rollers 82 is arranged between the first joint portion P1 and the second joint portion P2 in the first conveyance path L1. The pair of intermediate rollers 82 is arranged downstream of the pair of paper feed rollers 81 in the conveyance direction of the sheet of paper T. The pair of intermediate rollers 82 sandwiches the sheet of paper T that is conveyed by the pair of paper feed rollers 81, and conveys the sheet of paper T to the pair of registration rollers 80.

The return conveyance path Lb is a conveyance path that is provided to cause another surface (unprinted surface) opposite to a printed surface to face the intermediate transfer belt 7 when duplex printing is performed on a sheet of paper T. With the return conveyance path Lb, it is possible to reverse and return the sheet of paper T, which is conveyed from the first branching portion Q1 to the paper discharging unit 50, to the first conveyance path L1. In addition, it is possible to convey the sheet of paper T to upstream of the pair of registration rollers 80 that is disposed upstream of the second transfer roller 8. At the second transfer nip N2, a toner image is transferred to the unprinted surface of the sheet of paper T that has been reversed through the return conveyance path Lb.

A branch member 58 is provided at the first branch portion Q1. The branch member 58 causes the conveyance direction of a sheet of paper T conveyed from the fixing unit 9 through the third conveyance path L3 from upstream to downstream to branch off towards the paper discharging unit 50. Also the branch member 58 causes the conveyance direction of a sheet of paper T conveyed from the paper discharging unit 50 through the third conveyance path L3 from downstream to upstream to branch off towards the return conveyance path Lb.

The paper discharging unit 50 is formed at an end of the third conveyance path L3. The paper discharging unit 50 is arranged at an upper part of the main cabinet M. The paper discharging unit 50 opens from a left side surface (left side in FIG. 1) of the main cabinet M. The paper discharging unit 50 discharges the sheet of paper T outside the main cabinet M. The paper discharging unit 50 has a pair of discharge rollers 53. With the pair of discharge rollers 53, it is possible to cause the sheet of paper T conveyed from upstream to downstream through the third conveyance path L3 to be discharged outside the main cabinet M, and to cause the conveyance direction of the sheet of paper T to be reversed at the paper discharging unit 50, conveying the sheet of paper T to upstream of the third conveyance path L3.

A discharged paper accumulating portion M1 is formed at an opening side of the paper discharging unit 50. The discharged paper accumulating portion M1 is formed on a top surface (outside surface) of the main cabinet M. The discharged paper accumulating portion M1 is where the top surface of the main cabinet M is formed recessed downward. A bottom of the discharged paper accumulating portion M1 constitutes a part of the top surface of the main cabinet M. Sheets of paper T on which images are formed and which are discharged from the paper discharging unit 50 are stacked and collected at the discharged paper accumulating portion M1.

It should be noted that sensors for paper detection (not illustrated) are arranged at predetermined locations in conveyance paths, respectively. Operation of Printer 1

Next, operation of the printer 1 according to the first embodiment will be briefly described with reference to FIG. 1.

First, a case of performing single-side printing on a sheet of paper T stored in the paper cassette 52 will be described.

The sheet of paper T stored in the paper feed cassette 52 is fed to the first conveyance path L1 by the forward feed roller 61 and the pair of paper feed rollers 81, and is subsequently conveyed through the first joining portion P1 and the first conveyance path L1 to the pair of registration rollers 80 by the pair of intermediate rollers 82.

The operation of the forward feed roller 61 in detail will be described later.

At the pair of registration rollers 80, skew correction of the sheet of paper T and timing adjustment with formation of the toner image at the image forming unit GK are conducted.

The sheet of paper T discharged from the pair of registration rollers 80 is conveyed in the conveyance direction, and is introduced into between the intermediate transfer belt 7 and the secondary transfer roller 8 (secondary transfer nip N2) via the first conveyance path L1. Then, a toner image is transferred to the sheet of paper T between the intermediate transfer belt 7 and the secondary transfer roller 8.

Thereafter, the sheet of paper T is discharged from between the intermediate transfer belt 7 and the secondary transfer rollers 8, and is introduced into a fixation nip between the heating cylinder 9*a* and the pressing rotor 9*b* in the fixing unit 9 via the second conveyance path L2. Then, at the fixation nip, the toner is melted and fixed on the sheet of paper T.

Next, the sheet of paper T is conveyed to the paper discharging unit 50 via the third conveyance path L3, and is discharged from the paper discharging unit 50 to the discharged paper accumulating portion M1 by the pair of discharge rollers 53.

Thus, single side printing of the sheet of paper T stored in the paper feed cassette 52 is completed.

When single side printing is performed on a sheet of paper T placed on the manual tray 65, the sheet of paper T placed on the manual tray 65 is fed to the manual feed conveyance path La by the paper feed roller 66, and thereafter is conveyed to the pair of registration rollers 80 via the first joint portion P1 and the first conveyance path L1. The operation thereafter is similar to the single side printing of the sheet of paper T stored in the paper feed cassette 52 described above and the description will not be repeated.

Next, operation of the printer 1 when duplex printing is performed will be described.

When single side printing is performed, as described above, printing operation is completed when the sheet of paper T having undergone single side printing is discharged from, the paper discharging unit 50 to the discharged paper accumulating portion M1.

In contrast, when duplex printing is performed, the sheet of paper T having undergone single side printing is reversed via the return conveyance path Lb and conveyed to the pair of registration rollers 80 again. In this manner, duplex printing is performed on the sheet of paper T.

More specifically, until the sheet of paper T having undergone single side printing is discharged from the paper discharging unit 50 by the pair of discharge rollers 53, the operation is similar to single side printing described above. However, when duplex printing is performed, rotation of the pair of discharge rollers 53 stops and rotates reversely while the sheet of paper T having undergone single side printing is held by the pair of discharge rollers 53. When the pair of discharge rollers 53 rotates reversely, the Sheet of paper T that has been held by the pair of discharge rollers 53 is conveyed in a reverse direction (from paper discharging unit 50 to the first branch portion Q1) through the third conveyance path L3.

As described above, when the sheet of paper T is conveyed reversely through the third conveyance path L3, the sheet of paper T branches off to the return conveyance path Lb due to the branch member 58, and thereafter, joins the first conveyance path L1 via the second joint portion P2. At this point of time, the sheet of paper T is reversed with respect to the situation of the single side printing.

In addition, the pair of registration rollers 80 performs correction or adjustment of the sheet of paper T. The sheet of paper T is introduced into the secondary transfer nip N2 via the first conveyance path Li. Since an unprinted surface of the sheet of paper T faces the intermediate transfer belt 7 as a result of moving through the return conveyance path Lb, a toner image is transferred to the unprinted surface. Accordingly, duplex printing is performed on the sheet of paper T.

Details of Sheet Feeder Device 100 of Paper Feed and Discharge Portion KH

Next, the sheet feeder device 100 of the paper feed and discharge portion KH will be described in detail.

Figure 2:
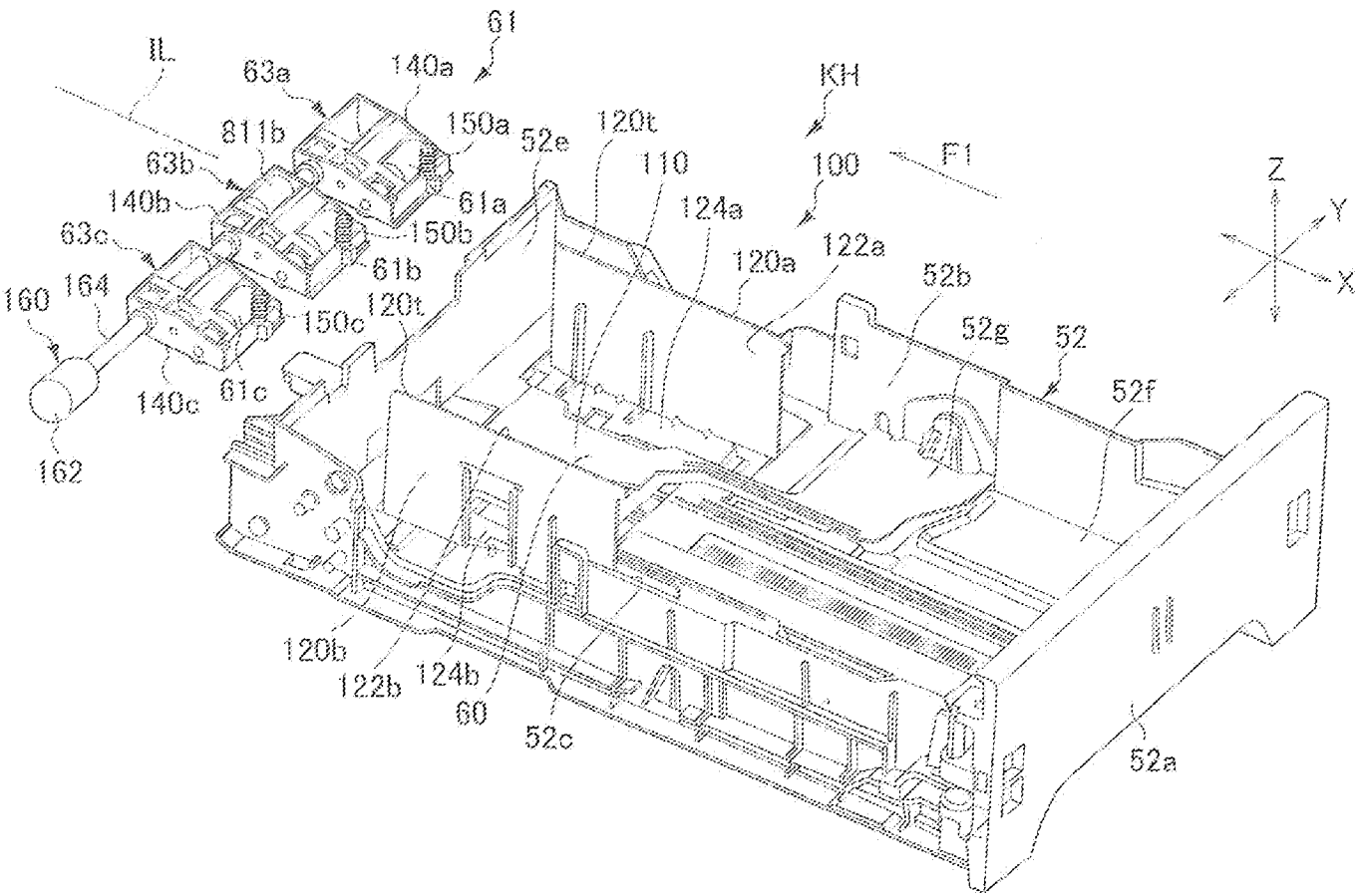
FIG. 2 is an exploded perspective view for explaining an arrangement of components in a sheet feeder device 100 of a paper feed and discharge portion KH shown in FIG. 1.

As shown in FIG. 2, the sheet feeder device 100 of the paper feed and discharge portion KH is provided with the paper feed cassette 52 as a sheet feeder, and the cassette feeder 51 of the feeder housing 130 (refer to FIG. 1).

The paper feed cassette 52 of the sheet feeder device 100 is provided with a sheet receptacle 110 and a pair of width adjustment guides 120*a* and 120*b*. The cassette feeder 51 of the feeder housing 130 of the sheet feeder device 100 is Provided with the forward feed roller 61 and a roller driving unit 160. The forward feed roller 61 is provided with pickup roller units 63*a*, 63*b* and 63*c*. The pair of width adjustment guides 120*a* and 120*b* is provided with a pair of facing parts 122*a* and 122*b* facing inside each other, and a pair of guide positioning units 124*a* and 124*b* that positions the pair of facing unit 122*a* and 122*b* at a predetermined position to be appropriate for both side surfaces of a plurality of stacked sheets of paper Ts.

The paper feed cassette 52 of the sheet feeder device 100 is provided with a cassette bottom 52*f*, cassette side surfaces 52*b* and 52*c*, rear surface 52*e*, and front cover 52*a*. The cassette bottom 52*f* has a substantially rectangular shape that is larger than the size of the greatest sheet of paper allowable to be stacked. The cassette side surfaces 52*b* and 52*c* project vertically in the same direction from ends of the cassette bottom 52*f* with respect to the direction of arrow Y. The rear surface 52*e* projects from an end of the cassette bottom 52*f* with respect to the conveyance direction F1 in the direction of arrow X, vertically in the same direction as the cassette side surfaces 52*b* and 52*c*. The front cover 52*a* projects from an end of the cassette bottom 52*f* with respect to a direction opposite to the conveyance direction F1 in the direction of arrow X. The paper feed cassette 52 has a recess 52*g* opening upward and extending in the direction of arrow Y, which is formed by the cassette bottom 52*f*, cassette side surfaces 52*b* and 52*c*, rear surface 52*e*, and front cover 52*a*.

The pair of width adjustment guides 120*a* and 120*b* is attached to the recess 52*g* movably in the direction of arrow Y. Facing parts 122*a* and 122*b* of the pair of width adjustment guides 120*a* and 120*b* are attached so as to be in parallel with each other and face with each other. The pair of width adjustment guides 120*a* and 120*b* are attached to the cassette bottom 52*f* of the recess 52 *g* so that the pair of facing unit 122*a* and 122*b* extends in the direction of arrow X and the direction of arrow Z.

The pair of guide positioning units 124*a* and 124*b* for positioning the pair of width adjustment guides 120*a* and 120*b* in the direction of arrow Y is formed at the recess 52*g* . That is, the pair of width adjustment guides 120*a* and 120*b* is attachable to the recess 52*g* so that the pair of facing units 122*a* and 122*b* comes in contact with side surfaces of plurality of stacked sheets of paper Ts that are perpendicular to the direction of arrow Y.

Therefore, the pair of guide positioning units 124*a* and 124*b* is configured to allow change in the dimension of the plurality of stacked sheets of paper Ts in the direction of arrow Y according to the type of the sheet of paper T. In addition, the pair of guide positioning units 124*a* and 124*b* is configured so that the position where the plurality of stacked . sheets of paper Ts is placed locates at the center of the recess 52*g* in the direction of arrow Y.

Figure 4:
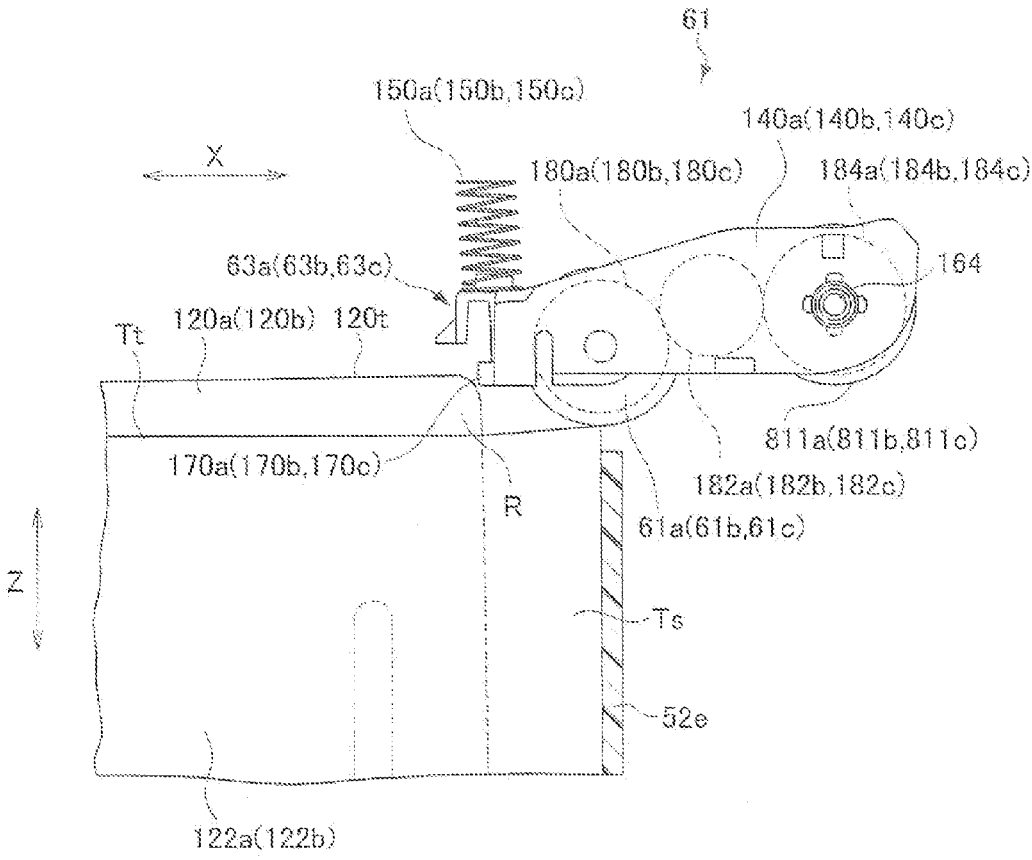
FIG. 4 is a partial cross section enlarged view taken along a plane extending in directions of arrow X and arrow Z for showing the forward feed roller 61 in FIG. 2.

Each of the pair of width adjustment guides 120*a* and 120*b* is provided with an upper end 120*t* extending straight in the direction of arrow X and a corner. R of an arc shape that is formed at an end of the upper end 120*t* in the conveyance direction F1. As shown in FIG. 4, the upper end 120*t* is configured to locate above an upper end of the rear surface 52*e*.

As shown in FIG. 2, the sheet receptacle 110 is an area sandwiched by the pair of width adjustment guides 120*a* and 120*b* in a recessed part of the recess 52*g*.

Figure 3:
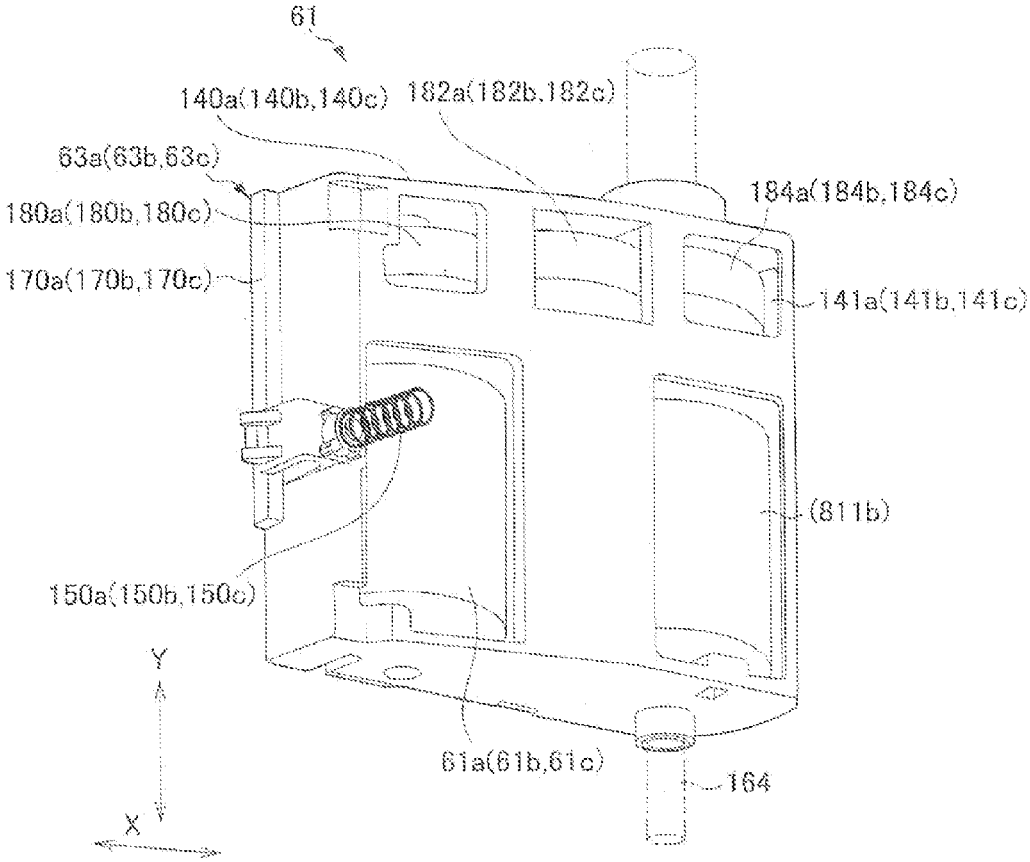
FIG. 3 shows an exploded perspective view of a forward feed roller 61 shown in FIG. 2.

As shown in FIGS. 2 and 3, the pickup roller units 63*a*, 63*b* and 63*c* are attached to a roller drive rotation shaft 164 of the feeder housing 130.

The pickup roller units 63*a*, 63*b* and 63*c* include pickup rollers (a plurality of rollers) 61*a*, 61*b* and 61*c*, pickup roller holders (a plurality of roller holders) 140*a*, 140*b* and 140*c* and roller biasing members (a plurality of roller biasing members) 150*a*, 150*b* and 150*c*, respectively.

The pickup rollers 61*a*, 61*b* and 61*c* are rotatably attached to the pickup roller holders 140*a*, 140*b* and 140*c*, respectively. Each of the pickup roller holders 140*a*, 140*b* and 140*c* has an exterior shape of a substantially rectangular parallelepiped shape, and opens downward.

The pickup roller holder 140*b* rotatably holds the upper paper feed roller 811*b*. The upper paper feed roller 811*b* is arranged at the pickup roller holder 140*b* so that a lower side of the upper paper feed roller 811*b* is exposed from the pickup roller holder 140*b*. It should be noted that the pickup roller holders 140*a* and 140*c* do not have an upper paper feed roller.

As shown in FIGS. 3 and 4, the pickup roller holders 140*a*, 140*b* and 140*c* rotatably hold first gears 180*a*, 180*b* and 180*c* which are unrotatably attached to the pickup rollers 61*a*, 61*b* and 61*c*, respectively,. The pickup roller holders 140*a*, 140*b* and 140*c* rotatably hold second gears 182*a*, 182*b* and 182*c* which engage with the first gears 180*a*, 180*b* and 180*c*, respectively. The pickup roller holder 140*b* rotatably holds a third gear 184*b* which is unrotatably attached to the upper paper feed roller 811*b*, such that the third gear 184*b* engages with the second gear 182*b*. In addition, the pickup roller holder 140*a* (140*c*) rotatably holds a third gear 184*a* (184*c*), such that the third gear 184*a* (184*c*) engages with the second gear 182*a* (182*c*).

The pickup roller holders 140*a*, 140*b* and 140*c* have guide contact parts 170*a*, 170*b* and 170*c* at their ends, respectively, which are closer to the pickup rollers 61*a* and 61*b* and 61*c*. than the upper paper feed roller 811*b* in the direction of arrow X. Each of the guide contact parts 170*a*, 170*b* and 170*c* has a pillar shape extending in the direction of arrow Y. Therefore, the guide contact parts 170*a*, 170*b* and 170*c* are configured to be in contact with one of the pair of width adjustment guides 120*a* and 120*b*, when the paper feed cassette 52 is mounted on the feeder housing 130.

As shown in FIG. 2, the pickup roller holders 140*a*, 140*b* and 140*c* are arranged spaced apart intervals with each other in the direction of arrow Y. The pickup roller holder 140*b* is arranged on an imaginary line IL extending in the direction of arrow X and passing the center of the paper feed cassette 52. The pickup roller holders 140*a* and 140*c* are arranged at positions of line symmetry centering the imaginary line IL.

The roller driving unit 160 is provided with a roller drive rotation shaft 164 unrotatably attached to the upper paper feed roller 811*b* and a roller actuator 162 to cause the roller drive rotation shaft 164 to rotate. Since the pickup roller holders 140*a*, 140*b* and 140*c* are arranged in the direction of arrow Y, the roller drive rotation shaft 164 extends in the direction of arrow Y. The roller drive rotation shaft 164 is rotatably supported by the main cabinet M. Therefore, the roller drive rotation shaft 164 supports the pickup roller holders 140*a*, 140*b* and 140*c* so that the pickup roller holders 140*a*, 140*b* and 140*c* are swingable in unison or separately about the roller drive rotation shaft 164. In other words, the pickup roller holders 140*a*, 140*b* and 140*c* movably hold the pickup rollers 61*a*, 61*b* and 61*c* in the direction of arrow Z.

The pickup roller holders 140*a*, 140*b* and 140*c* are regulated by a stopper (not illustrated), so as not to swing excessively downward to exceed the upper end of the rear surface 52*e*.

The roller biasing members 150*a*, 150*b* and 150*c* are compression springs. An end of each of the roller biasing members (a plurality of roller biasing members) 150*a*, 150*b* and 150*c* is attached to an upper part of each of the pickup roller holders 140*a*, 140*b* and 140*c*, upstream of the conveyance direction F1 in the direction of arrow X. The other end of each of the roller biasing members 150*a*, 150*b* and 150*c* is attached to the main cabinet M. Therefore, each of the roller biasing members 150*a*, 150*b* and 150*c* applies a biasing force such that an upstream part of each of the pickup roller holders 140*a*, 140*b* and 140*c* with respect to the conveyance direction is depressed downward in the direction of arrow z. (towards the sheet receptacle 110).

Therefore, depending on the position of the pair of width adjustment guides 120*a* and 120*b*, upper ends 120*t* cause at least one of the pickup roller holders 140*a*, 140*b* and 140*c* to move upwards in the direction of arrow Z so as to be in a non-contacting state (at least one of the pickup rollers 61*a*, 61*b* and 61*c* is not in contact with the topmost sheet of paper Tt), when the paper feed cassette 52 is mounted on the feeder housing 130. For example, when the size of a plurality of stacked sheets of paper Ts is small, the upper ends 120*t* cause the pickup roller holders 140*a* and 140*c* to move upwards in the direction of arrow Z so that the pickup rollers 61*a* and 61*c* are not in contact with a topmost sheet of paper Tt. As a result, only the pickup roller 61*b* is in contact with the topmost sheet of paper Tt. When the size of a plurality of stacked sheets of paper Ts is equal to the allowable largest size, the upper ends 120*t* do not come in contact with any of the pickup roller holders 140*a*, 140*b* and 140*c*. Accordingly, the pickup roller holders 140*a*, 140*b* and 140*c* do not move upward. As a result, all the pickup rollers 61*a*, 61*b* and 61*c* come in contact with a topmost sheet of paper Tt.

Details of Operation of Sheet Feeder Device 100

Next, operation of the sheet feeder device 100 will be described in detail.

Descriptions will be provided for a case where the size of a plurality of stacked sheets of paper Ts is equal to the allowable largest size.

First, a user takes out the paper feed cassette 52 from the feeder housing 130 of the main cabinet M.

Next, as shown in FIG. 2, the user mounts a plurality of stacked sheets of paper Ts composed of sheets of paper T of required size on the sheet receptacle 110 so that an end of the plurality of stacked sheets of paper Ts comes into contact with the rear surface 52*e*. Accordingly, the placing board 60, which is biased by a biasing force exerted by a biasing member (not illustrated), raises a downstream portion in the conveyance direction F1 of the plurality of stacked sheets of paper Ts, such that a topmost sheet of paper Tt reaches a position slightly above an upper end of the rear surface 52*e*. Since the size of the plurality of stacked sheets of paper Ts is equal to the allowable largest size, there is substantially no gap between both sides of the plurality of stacked sheets of paper Ts and the recess 52*g* in the direction of arrow Y.

Next, the user adjusts positions of the pair of width adjustment guides 120*a* and 120*b* in the direction of arrow Y so that the pair of facing units 122*a* and 122*b* comes in contact with both sides of the plurality of stacked sheets of paper Ts, respectively. At this point of time, the positions of the pair of width adjustment guides 120*a* and 120*b* are adjusted so that distance between them is at a maximum. Accordingly, the plurality of stacked sheets of paper Ts is arranged at the center of the recess 52*g* in the direction of arrow Y.

Next, the user mounts the paper feed cassette 52 on the feeder housing 130 of the main cabinet M. Simultaneously, the pickup roller holders 140*a*, 140*b* and 140*c* operate as follows.

Figure 5:
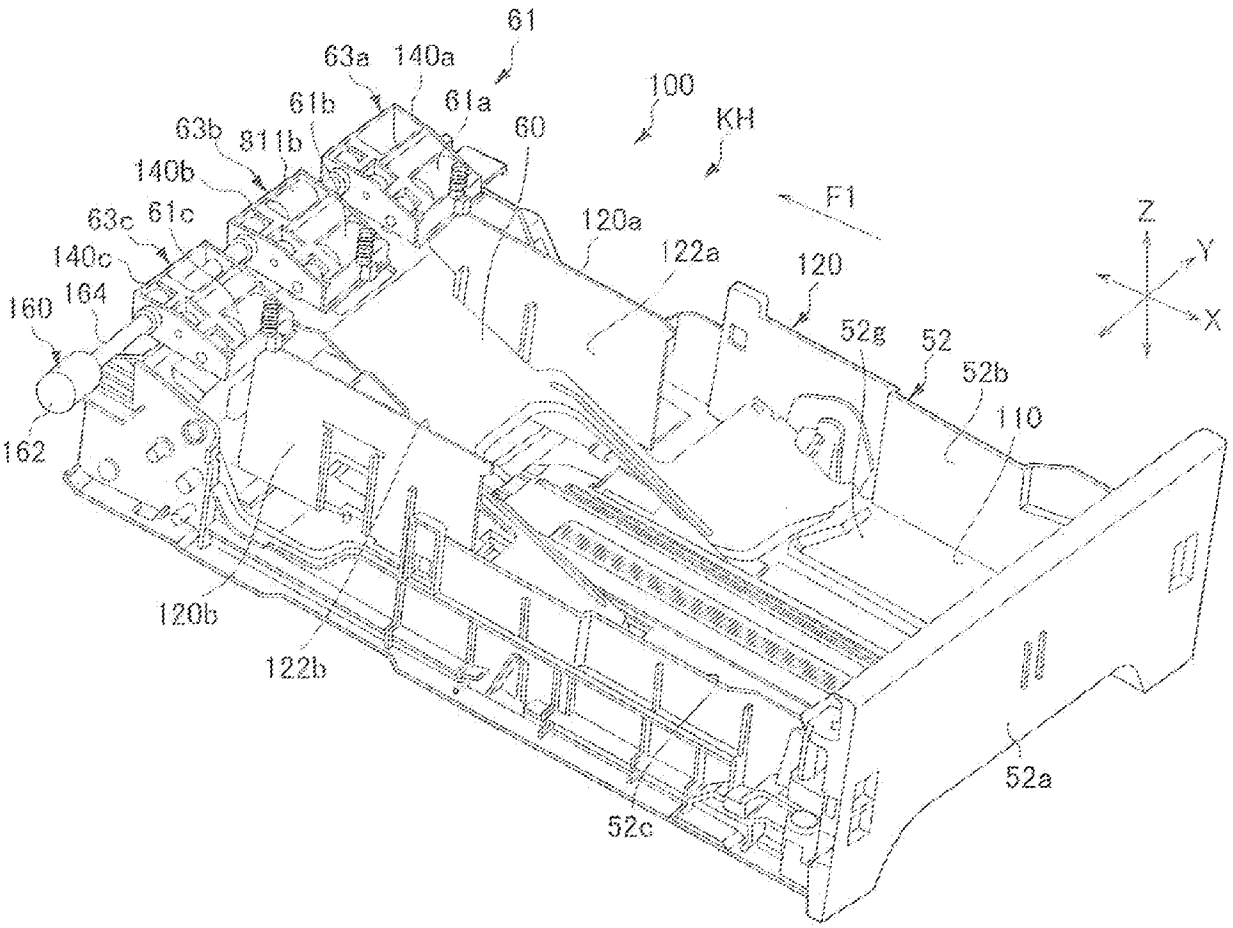
FIG. 5 is an exploded perspective view for explaining a paper feed cassette 52 of the sheet feeder device 100 of the sheet feed and discharge portion KH shown in FIG. 2 mounted on a case.
Figure 6:
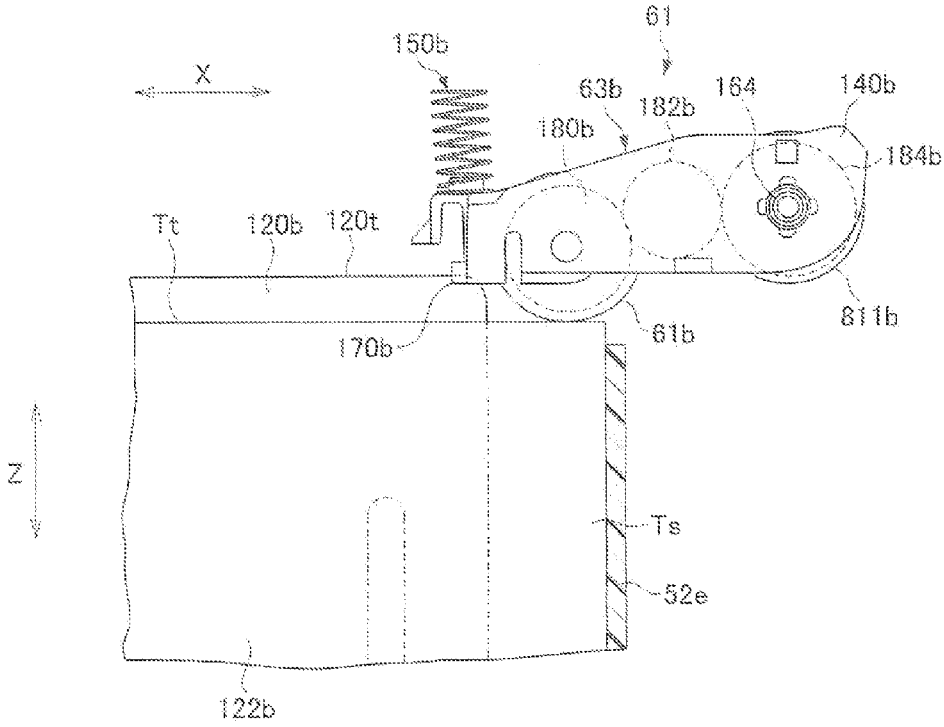
FIG. 6 is a partial cross section enlarged view taken along the plane extending in the directions of arrow X and arrow Z for explaining a pickup roller 61*b* of the forward feed roller 61 shown in FIG. 5 being in contact with a stacked sheet of paper Ts.

When the paper feed cassette 52 is completely placed in the feeder housing 130 as shown in FIG. 5, none of the guide contact parts 170*a*, 170*b* and 170*c* are in contact with the pair of width adjustment guides 120*a* and 120*b* as shown in FIG. 6.

More specifically, since the guide contact parts 170*a*, 170*b* and 170*c* locate between the pair of width adjustment guides 120*a* and 120*b* in the direction of arrow Y even if the paper feed cassette 52 is completely pushed into the feeder housing 130, the guide contact parts 170*a*, 170*b* and 170*c* do not come in contact with the pair of width adjustment guides 120*a* and 120*b*. Therefore, the contact between the pickup rollers 61*a*, 61*b* and 61*c* and the topmost sheet of paper Tt is maintained (contacting state).

When the user activates the printer 1, the roller actuator 162 starts to rotate according to the timing of feeding, causing the pickup rollers 61*a*, 61*b* and 61*c* to rotate via the roller drive rotation shaft 164.

Since the contact between the pickup rollers 61*a*, 61*b* and 61*c* and the topmost sheet of paper Tt is maintained at this point of time, rotation forces exerted by the three pickup rollers 61*a*, 61*b* and 61*c* are transmitted to the topmost sheet of paper Tt.

Since the rotation forces of the pickup rollers 61*a*, 61*b* and 61*c* act on the center of the topmost sheet of paper Tt and positions line symmetrical with respect to the imaginary line IL in the direction of arrow Y, the topmost sheet of paper Tt is conveyed to the image forming unit GK, without undergoing rotation about arrow Z.

Furthermore, the total sum of pressing forces applied to the topmost sheet of paper Tt by the pickup rollers 61*a*, 61*b* and 61*c* presses is equal to the total of biasing forces exerted by the roller biasing members 150*a*, 150*b* and 150*c*. The total sum of the biasing forces at this situation is substantially proportional to the length of the topmost sheet of paper Tt in the direction of arrow Y. Accordingly, a conveyance force of an appropriate range will act on the topmost sheet of paper Tt. In this manner, the topmost sheet of paper Tt is conveyed. reliably and it may be unlikely that multiple feeding occurs during the conveyance of the topmost sheet of paper Tt.

Next, descriptions will be provided for a case where the size of a plurality of stacked sheets of paper Ts is smaller than the allowable largest size. It should be noted that descriptions related to operation of the paper feed and discharge portion KH will not be repeated, which is common to the case where the size of the plurality of stacked sheets of paper Ts is equal to the allowable largest size.

Since the size of the plurality of stacked sheets of paper Ts is smaller than the allowable largest size, there is a gap between both sides of the plurality of stacked sheets of paper Ts and the recess 52*g* in the direction of arrow Y.

Accordingly, the user adjusts positions of the pair of width adjustment guides 120*a* and 120*b*, so that the pair of facing parts 122*a* and 122*b* comes in contact with both sides of the plurality of stacked sheets of paper Ts, respectively. Accordingly, the plurality of stacked sheets of paper Ts is mounted at the center of the recess 52*g* in the direction of arrow Y.

Next, the user mounts the paper feed cassette 52 on the paper feeder housing 130 of the main cabinet M. Simultaneously, the pickup roller holders 140*a*, 140*b* and 140*c* operate as follows.

As shown in FIG. 4, when a part of the paper feed cassette 52 is pushed into the feeder housing 130, the guide contact parts 170*a*, 170*b* and 170*c* of the pickup roller holders 140*a*, 140*b* and 140*c* approach to the pair of width adjustment guides 120*a* and 120*b*. Since none of the guide contact parts 170*a*, 170*b* and 170*c* come in contact with the pair of width adjustment guides 120*a* and 120*b*, a tip of each of the pickup roller holders 140*a*, 140*b* and 140*c* locates downward in the direction of arrow Z.

When an entire of the paper feed cassette 52 is pushed into the feeder housing 130 completely as shown in FIG. 5, the guide contact part 170*b* among the guide contact parts 170*a*, 170*b* and 170*c* does not come in contact with the pair of width adjustment guides 120*a* and 120*b* as shown in FIG. 6. In contrast, as shown in FIG. 7, the guide contact parts 170*a* and 170*c* come in contact with the pair of width adjustment guides 120*a* and 120*b*.

More specifically, since the guide contact part 170*b* locates between the pair of width adjustment guides 120*a* and 120*b* in the direction of arrow Y even if the paper feed cassette 52 is pushed into the feeder housing 130 completely, the guide contact Part 170*b* does not come in contact with the pair of width adjustment guides 120*a* and 120*b*. Therefore, the contact between the pickup roller 61*b* and the topmost sheet of paper Tt is maintained (contacting state).

Figure 7:
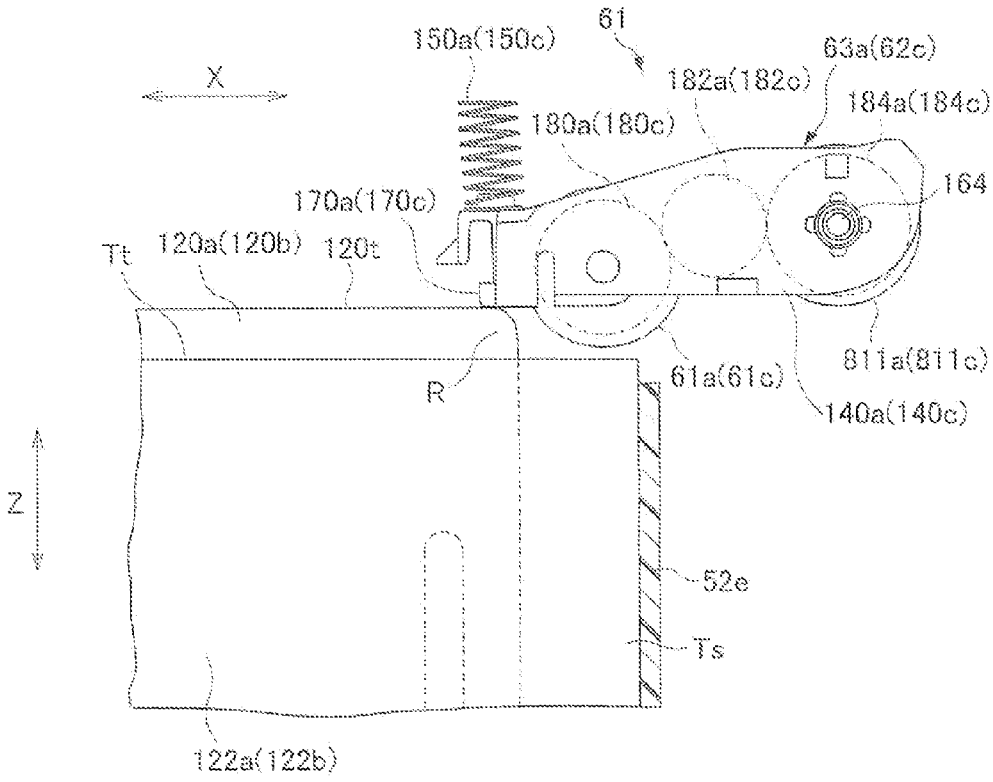
FIG. 7 is a partial cross section enlarged view taken along the plane extending in the directions of arrow X and arrow Z for explaining the pickup roller 61*a* of the forward feed roller 61 shown in FIG. 5 being not in contact with the stacked sheet of paper Ts.

However, when the guide contact parts 170*a* and 170*c* are arranged such that the distance between them is substantially equal to the distance between the pair of width adjustment guides 120*a* and 120*b*, the guide contact parts 170*a* and 170*c* come in contact with the pair of width adjustment guides 120*a* and 120*b*, respectively, as shown in FIG. 7. The guide contact parts 170*a* and 170*c* mount the upper ends 120*t* of the pair of width adjustment guides 120*a* and 120*b*, respectively, while resisting biasing forces exerted by the roller biasing members 150*a* and 150*c*. Since the pickup rollers 61*a* and 61*c* are lifted at this situation, the contact between the pickup rollers 61*a* and 61*c* and a topmost sheet of paper Tt is released (non-contacting state).

When the user activates the printer 1, the roller actuator 162 starts to rotate according to the timing of feeding, causing the pickup rollers 61*a*, 61*b* and 61*c* to rotate via the roller drive rotation shaft 164.

Since the contact between the pickup rollers 61*a* and 61*c* and the topmost sheet of paper Tt is released, only the rotation force exerted by the pickup roller 61*b* is transmitted to the topmost sheet of paper Tt.

Accordingly, the rotation force exerted by the pickup roller 61*b* acts on the center of the topmost sheet of paper Tt in the direction of arrow Y. In this manner, the center position of the topmost sheet of paper Tt substantially matches the position of the pickup roller 61*b* in the direction of arrow Y. For this reason, the topmost sheet of paper Tt is conveyed to the image forming unit GK almost without undergoing rotation about arrow Z.

Furthermore, the pressing force applied to the topmost sheet of paper Tt by the pickup roller 61*b* is equal to the biasing force exerted by the roller biasing member 150*b*. Although the pressing force at this situation is substantially ⅓ of the pressing force of the case where the plurality of stacked sheets of paper Ts is equal to the allowable largest size, the length of the topmost sheet of paper Tt in the direction of arrow Y also decreases at substantially the same ratio. For this reason, a conveyance force of an appropriate range acts on the topmost sheet of paper Tt. In this manner, the topmost sheet of paper Tt is conveyed reliably and it may be unlikely that multiple feeding occurs during the conveyance of the topmost sheet of paper Tt.

In this manner, all that required of the user to apply the conveyance force to the topmost sheet of paper Tt according to the size of the sheet of paper T is only to mount sheets of paper T having a predetermined size on the paper feed cassette 52 and adjust the position of the pair of width adjustment guides 120*a* and 120*b*.

According to the printer 1 and the sheet feeder device 100 of this embodiment, there are the following advantageous effects, for example.

The printer 1 and the sheet feeder device 100 of this embodiment are provided with: the paper feed cassette (sheet feeder) 52 of the paper feed and discharge portion KH, which conveys a topmost sheet of paper Tt in the conveyance direction F1, feeding the topmost sheet of paper Tt to the image forming unit GK, the topmost sheet of paper Tt being on top of a plurality of sheets of paper Ts having a rectangular parallelepiped shape composed of sheets of paper T having a rectangular shape stacked in the direction of arrow Z; and the main cabinet M having the feeder housing 130 which attachably and detachably mounts the paper feed cassette 52.

The paper feed cassette 52 is provided with the sheet receptacle 110, the pair of width adjustment guides 120*a* and 120*b*, the pickup rollers 61*a*, 61*b* and 61*c*, the pickup roller holders 140*a*, 140*b* and 140*c*, the roller biasing members 150*a*, 150*b* and 150*c* and the roller driving unit 160. The sheet receptacle 110 is configured to store the plurality of stacked sheets of paper Ts so that the topmost sheet of paper Tt is conveyable in the conveyance direction F1.

The pair of width adjustment guides 120*a* and 120*b* is attached to the sheet receptacle 110 so that their positions are adjustable in the sheet width direction according to the distance between both sides of the plurality stacked of sheets of paper Ts in the direction of arrow Y. Each of the pickup rollers 61*a*, 61*b* and 61*c* is arranged at an upstream portion in the conveyance direction F1 of each of the pickup roller holders 140*a*, 140*b* and 140*c* while being spaced apart in the direction of arrow Y, when the paper feed cassette 52 is mounted on the feeder housing 130. Each of the pickup roller holders 140*a*, 140*b* and 140*c* holds each of the pickup rollers 61*a*, 61*b* and 61*c* relatively rotatable and movable in the direction of arrow Z. The roller biasing members 150*a*, 150*b* and 150*c*, bias the pickup roller holders 140*a*, 140*b* and 140*c* toward the sheet receptacle 110 in the direction of arrow Z so that at least one of the pickup rollers 61*a*, 61*b* and 61*c* comes in contact with the topmost sheet of paper Tt, when the paper feed cassette 52 is mounted on the feeder housing 130. The roller driving unit 160 is configured to cause the pickup rollers 61*a*, 61*b* and 61*c* to rotate.

The pair of width adjustment guides 120*a* and 120*b* include: the pair of facing parts 122*a* and 122*b* which face both sides of the plurality of stacked sheets of paper Ts; the pair of guide positioning units 124*a* and 124*b*; and the pair of upper ends 120*t*. The pair of guide positioning units 124*a* and 124*b* is configured to Position the facing parts 122*a* and 122*b* so that the distance between them matches the size of the plurality of stacked sheets of paper Ts with respect to the direction of arrow Y, before the paper feed cassette 52 is mounted on the feeder housing 130. The pair of upper ends 120*t* is configured to cause at least one of the pickup roller holders 140*a*, 140*b* and 140*c* to move opposite to the sheet receptacle 110 in the direction of arrow Z such that a pickup roller does not come in contact with a topmost sheet of paper Tt, when the paper feed cassette 52 is mounted on the feeder housing 130.

Accordingly, the pair of upper ends 120*t* causes at least one of the pickup roller holders 140*a*, 140*b* and 140*c* to move opposite to the sheet receptacle 110 in the direction of arrow Z so that the pickup rollers 61*a*, 61*b* and 61*c* do not come in contact with the topmost sheet of paper Tt, when the paper feed cassette 52 is mounted on the feeder housing 130. Since the guide contact part 170*b* is positioned between the pair of width adjustment guides 120*a* and 120*b* even if the paper feed cassette 52 is pushed into the feeder housing 130 completely, the guide contact part 170*b* does not come in contact with the pair of width adjustment guides 120*a* and 120*b*. Therefore, the contact between the pickup roller 61*b* and the topmost sheet of paper Tt is maintained.

Accordingly, all that is required of a user is to mount sheets of paper T having a predetermined size on the paper feed cassette 52 and to adjust the position of the pair of width adjustment guides 120*a* and 120*b* such that the rotation force of the pickup rollers 61*a*, 61*b* and 61*c* acts on the center of the topmost sheet of paper Tt or positions line symmetrical with respect to the imaginary line IL in the direction of arrow Y. In this manner, an appropriate conveyance force will stably act on the topmost sheet of paper Tt according to the size of a sheet of paper T and the paper feed cassette 52 will convey the topmost sheet of paper Tt to the image forming unit GK.

Furthermore, when the size a sheet of paper T that the user places is equal to the allowable largest size, the total sum of the pressing force applied to a topmost sheet of paper Pt by the pickup rollers 61*a*, 61*b* and 61*c* is equal to the total sum of the biasing force applied by the roller biasing members 150*a*, 150*b* and 150*c*. The total sum of the pressing force under such a situation is substantially proportional to the length of the topmost sheet of paper Tt in the direction of arrow Y. For this reason, a conveyance force of an appropriate range acts on the topmost sheet of paper Tt. In this manner, the topmost sheet of paper Tt is conveyed reliably and it may be unlikely that multiple feeding occurs during the conveyance of the topmost sheet of paper Tt.

In addition, when the size of a sheet of paper T that the user placed is smaller than the allowable largest size, a pressing force applied to a topmost sheet of paper Tt by the pickup roller 61*b* is equal to a biasing force applied by the roller biasing member 150*b*. Although the pressing force of this case is substantially ⅓ of the pressing force of the case where the size of the sheet of paper T is equal to the allowable largest size, the length of the topmost sheet of Paper Tt in the direction of arrow Y also decreases at substantially the same rate. For this reason, a conveyance force of an appropriate range acts on the topmost sheet of paper Tt. In this manner, the topmost sheet of paper Tt is conveyed reliably and it may be unlikely that multiple feeding occurs during the conveyance of the topmost sheet of paper Tt.

In addition, according to the printer 1 and the sheet feeder device 100 of this embodiment, the pair of guide positioning units 124*a* and 124*b* is attached to the sheet housing 110 so that the plurality of stacked sheets of paper Ts is positioned at the center of the sheet housing 110 in the direction of arrow Y. The pickup rollers 61*a*, 61*b* and 61*c* are symmetrically arranged at the feeder housing 130 so that the imaginary line IL passing through the center of the plurality of stacked sheets of paper Ts in the direction of arrow Y and extending in the conveyance direction F1 matches an axis of line symmetry.

Accordingly, the paper feed cassette 52 applies a conveyance force to the topmost sheet of paper Tt symmetrically with respect to left and right directions.

In addition, according to the printer 1 and the sheet feeder device 100 of this embodiment, the pickup roller holders 140*a*, 140*b* and 140*c* have guide contact parts 170*a*, 170*b* and 170*c* which come in contact with an upper end 120*t* of either one of the pair of width adjustment guides 120*a* and 120*b*, when the paper feed cassette 52 is mounted on the feeder housing 130. Upper ends 120*t* of the pair of width adjustment guides 120*a* and 120*b* are formed in a shape such that when the paper feed cassette 52 is mounted on the feeder housing 130 and an upper end 120*t* of either one of the pair of width adjustment guides 120*a* and 120*b* comes in contact with one of the plurality of guide contact parts 170*a*, 170*b* and 170*c*, the upper end 120*t* of either one of the pair of width adjustment guides 120*a* and 120*b* raises the pickup roller opposite to the sheet housing 110 in the direction of arrow z, so that the pickup roller having the guide contact part in contact with the upper end 120*t* does not come in contact with the topmost sheet of paper Tt.

In this manner, when the paper feed cassette 52 is mounted on the feeder housing 130 and the upper end 120*t* comes in contact with any one of the guide contact parts, the pickup roller having the guide contact part in contact with the upper end 120*t* easily moves upward in the direction of arrow Z so as not to come in contact with the topmost sheet of paper Tt.

In addition, according to the printer 1 and the sheet feeder device 100 of this embodiment, the roller driver unit 160 has the roller drive rotation shaft 164, that is unrotatably attached to the output shaft of the roller actuator 162 and extends in the direction of arrow Y. The roller drive rotation shaft 164 swingably holds the pickup roller holders 140*a*, 140*b* and 140*c* about the roller drive rotation shaft 164. Rotation of the roller drive rotation shaft 164 causes the pickup rollers 61*a*, 61*b* and 61*c* to rotate.

Since one roller drive rotation shaft 164 always causes the pickup rollers 61*a*, 61*b* and 61*c* to rotate regardless of which one of the pickup rollers 61*a*, 61*b* and 61*c* is in contact with the topmost sheet of paper Tt, there is no need to have a mechanism for individually stopping rotation of a pickup roller that is not in contact with the topmost sheet of paper Tt.

Although a preferred embodiment of the present invention has been explained in the foregoing, the present invention is not to be limited to the aforementioned embodiment. The present invention can be employed in various forms.

Although the forward feed roller 61 is constituted by the three pickup roller units 63*a*, 63*b* and 63*c*, the present invention is not limited thereto, and for example, the number of the pickup roller units may be five or seven. The number may be even as well as odd. When the number of the pickup roller units is an even number, a pickup roller unit is not arranged at the imaginary line IL.

The roller biasing members 150*a*, 150*b* and 150*c* are not limited. to the compression springs as described in the embodiment. Other biasing mechanisms may be employed such as an extension spring, an air spring, and the repulsive force of magnets.

In addition, although the roller drive rotation shaft 164 swingably supports the pickup roller holders 140*a*, 140*b* and 140*c* about the roller drive rotation shaft 164, in unison or independently as described in the embodiment, the present invention is not limited to this. The roller drive rotation shaft 164 may detachably support the pickup roller holders 140*a*, 140*b* and 140*c* about the roller drive rotation shaft 164, as well as swingably in unison or independently.

The image forming apparatus of a so-called indirect transfer type has been described in the embodiment, in which a transfer nip as the secondary transfer nip N2 is formed between the intermediate transfer belt and the secondary transfer roller. However, the present invention is not limited to this. For example, in the case of an image forming apparatus of a direct transfer type, a transfer nip is formed between a photoreceptor drum and a transfer roller.

The kind of image forming apparatus of the present invention is not limited in particular, and may be a copier, printer, facsimile machine, or multi functional machine including these.

The kind of sheet feeder of the present invention is not limited in particular, and may be of a copier, printer, facsimile machine, scanner, or multi functional machine including these.

In addition, although the printer 1 has been described with an example of a sheet of paper in the above embodiment, it is not limited to the sheet of paper as long as it is a sheet of medium, for example, a sheet of film.

What is claimed is:

1. A sheet feeder device comprising:

a sheet feeder configured to store a plurality of sheets of media; and a case having a feeder housing configured to attachably and detachably mount the sheet feeder, wherein the sheet feeder includes:

a sheet receptacle configured to store the plurality of sheets of media such that the plurality of sheets of media are conveyable in a conveyance direction; and a pair of width adjustment guides configured to position each of the plurality of sheets of media in a sheet width direction, the pair of width adjustment guides being attached to the sheet receptacle such that a position of the pair of width adjustment guides is adjustable in the sheet width direction, wherein the feeder housing includes:

a plurality of rollers arranged on an exit side of the sheet feeder that is mounted on the feeder housing, the plurality of rollers being spaced each other in the width direction;

a plurality of roller holders configured to hold the plurality of rollers rotatable and movable in a sheet thickness direction;

a plurality of roller biasing members configured to urge the plurality of roller holders to come in contact with a topmost sheet of medium, when the sheet feeder is mounted on the feeder housing; and a roller driver unit configured to cause the plurality of rollers to rotate, and wherein the pair of width adjustment guides includes: a pair of facing parts configured to face both side surfaces of the plurality of sheets of media; a pair of guide positioning units configured to position the pair of facing parts; and a guide end configured to cause one of the plurality of roller holders to move more upward than other remaining roller holders, when the sheet feeder is mounted on the feeder housing.

2. The sheet feeder device according to claim 1, wherein the pair of guide positioning units is attached to the sheet receptacle such that the plurality of sheets of media centers the sheet receptacle in the sheet width direction, and the plurality of rollers is symmetrically arranged at the feeder housing with respect to an axis of line symmetry, which matches an imaginary line that passes through a center of the plurality of sheets of media in the sheet width direction and extends in the conveyance direction.

3. The sheet feeder device according to claim 1, wherein each of the plurality of roller holders has a guide contact part configured to come in contact with a guide end of one of the pair of width adjustment guides, when the sheet feeder is mounted on the feeder housing, and the guide end is configured to be shaped to press up a roller holder in a direction opposite to the sheet receptacle in the sheet thickness direction in order to prevent a roller of the roller holder from coming into contact with the topmost sheet of medium, when the sheet feeder is mounted on the feeder housing and the guide end of the one of the pair of width adjustment guides comes into contact with one of guide contact parts of the plurality of roller holders.

4. The sheet feeder device according to claim 1, wherein the roller driver unit has a roller actuator, and, a roller drive rotation shaft configured to be unrotatably attached to an output shaft of the roller actuator and to extend in the sheet width direction, the roller drive rotation shaft is configured to swingably hold the plurality of roller holders about the roller drive rotation shaft, and rotation of the roller drive rotation shaft causes the plurality of rollers to rotate.

5. An image forming apparatus comprising:

an image forming device that is provided in the case and configured to form an image on a sheet of medium; and the sheet feeder device according to claim 1 configured to supply the sheet of medium to the image forming device.

6. An image forming apparatus comprising:

an image forming device that is provided in the case and configured to form an image on a sheet of medium; and the sheet feeder device according to claim 2 configured to supply the sheet of medium to the image forming device.

7. An image forming apparatus comprising:

an image forming device that is provided in the case and configured to form an image on a sheet of medium; and the sheet feeder device according to claim 3 configured to supply the sheet of medium to the image forming device.

8. An image forming apparatus comprising:

an image forming device that is provided in the case and configured to form an image on a sheet of medium; and the sheet feeder device according to claim 4 configured to supply the sheet of medium to the image forming device.

* * * * *